US010119430B2

(12) United States Patent
Junker et al.

(10) Patent No.: US 10,119,430 B2
(45) Date of Patent: Nov. 6, 2018

(54) TRANSMISSION ELEMENT FOR RECIPROCATING PISTON INTERNAL COMBUSTION ENGINES

(71) Applicant: Schaeffler Technologies AG & Co. KG, Herzogenaurach (DE)

(72) Inventors: Marco Junker, Obernzenn (DE); Norbert Geyer, Hochstadt (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 112 days.

(21) Appl. No.: 15/140,996

(22) Filed: Apr. 28, 2016

(65) Prior Publication Data

US 2016/0369659 A1 Dec. 22, 2016

(30) Foreign Application Priority Data

Jun. 17, 2015 (DE) ..... 10 2015 211 122

(51) Int. Cl.
*F01L 1/24* (2006.01)
*F01L 1/18* (2006.01)
*F01L 1/26* (2006.01)

(52) U.S. Cl.
CPC ..... *F01L 1/2411* (2013.01); *F01L 1/181* (2013.01); *F01L 1/267* (2013.01)

(58) Field of Classification Search
CPC ..... F01L 1/2411; F01L 1/181; F01L 1/267
See application file for complete search history.

(56) References Cited

U.S. PATENT DOCUMENTS 2,380,051 A * 7/1945 Kettering ..... F01L 1/181 123/90.4
4,387,680 A * 6/1983 Tsunetomi ..... F01L 1/181 123/198 F
4,924,821 A * 5/1990 Teerman ..... F01L 1/2411 123/90.22
6,065,434 A * 5/2000 Schmidt ..... F01L 1/2411 123/90.43
6,439,195 B1 * 8/2002 Warner ..... F01L 13/06 123/320
2001/0027773 A1 * 10/2001 Janak ..... F01L 1/181 123/321
2008/0196683 A1 * 8/2008 Hayman ..... F01L 1/185 123/90.46
2013/0000573 A1 1/2013 Sailer et al.

FOREIGN PATENT DOCUMENTS

DE 102010018208 10/2011

* cited by examiner

*Primary Examiner* — Vicky A Johnson
(74) *Attorney, Agent, or Firm* — Volpe and Koenig, P.C.

(57) ABSTRACT

A transmission element in the form of a rocker arm (1) or swinging arm for a reciprocating piston internal combustion engine is provided that can be actuated on one side by a cam of a camshaft and on the other side is in active connection with at least one gas exchange valve directly or via an intermediate arrangement of a valve bridge. The transmission element has a hydraulic valve lash compensation element, also called "HVA", and the hydraulic valve lash compensation element is arranged at a force transmission end of and attached to the transmission element.

7 Claims, 2 Drawing Sheets

TRANSMISSION ELEMENT FOR RECIPROCATING PISTON INTERNAL COMBUSTION ENGINES

INCORPORATION BY REFERENCE

The following documents are incorporated herein by reference as if fully set forth: German Patent Application No. DE 102015211122.9, filed Jun. 17, 2015.

BACKGROUND

The invention relates to a transmission element in the form of a rocker arm or swinging arm for reciprocating piston internal combustion engines that can be actuated on one side by a cam of a camshaft and is in active connection on the other side with at least one gas exchange valve directly or under intermediate arrangement of a valve bridge, wherein the transmission element has a hydraulic valve lash compensation element, also called "HVA" below.

DE 10 2010 018 208 A1 describes a transmission element in the form of a rocker arm that has, facing the gas exchange valve, a hydraulic valve lash compensation element that is installed in the rocker arm end. Due to the installation of the HVA, an extension of the rocker arm end is required that has too large a volume, especially in multi-valve internal combustion engines and the installation of a central injector that has spatial requirements.

SUMMARY

The object of the invention is thus to provide a transmission element with an HVA whose end has a narrow construction transverse to its orientation, that is, viewed in the direction of the cylinder head.

This objective is achieved in that the hydraulic valve lash compensation element is arranged before the transmission element, viewed in its direction of movement, and is attached to this element. In this way, the previously integrated positioning of the HVA is replaced by a hydraulic valve lash compensation element arranged upstream in the direction of force, so that the transverse extent of the end/head of the transmission element can have a considerably narrower construction. In another construction of the invention it is provided that the hydraulic valve lash compensation element has a plug-in extension with reduced diameter that is inserted in the transmission element and is attached there. In this way, only a single hole is required in the transmission element, so that the end width can have a considerably narrower construction. The plug-in extension is advantageously a part of a housing of the hydraulic valve lash compensation element, so that the valve lash compensation element has a typical construction and can be combined with the housing. The plug-in extension advantageously has a hollow construction, wherein the hollow space is connected to a pressurized medium line in the transmission element and takes over the supply of the hydraulic valve lash compensation element with pressurized medium. In the housing of the HVA, standard extrusion pressed parts can be installed, e.g., as working pistons, wherein also the other installed valve pistons in standard construction can be used. For venting the HVA, a leakage gap toward the housing is provided between the working piston or the valve piston.

BRIEF DESCRIPTION OF THE DRAWINGS

The invention is described in the drawings, in which.

DETAILED DESCRIPTION OF THE PREFERRED EMBODIMENTS

Figure 1:
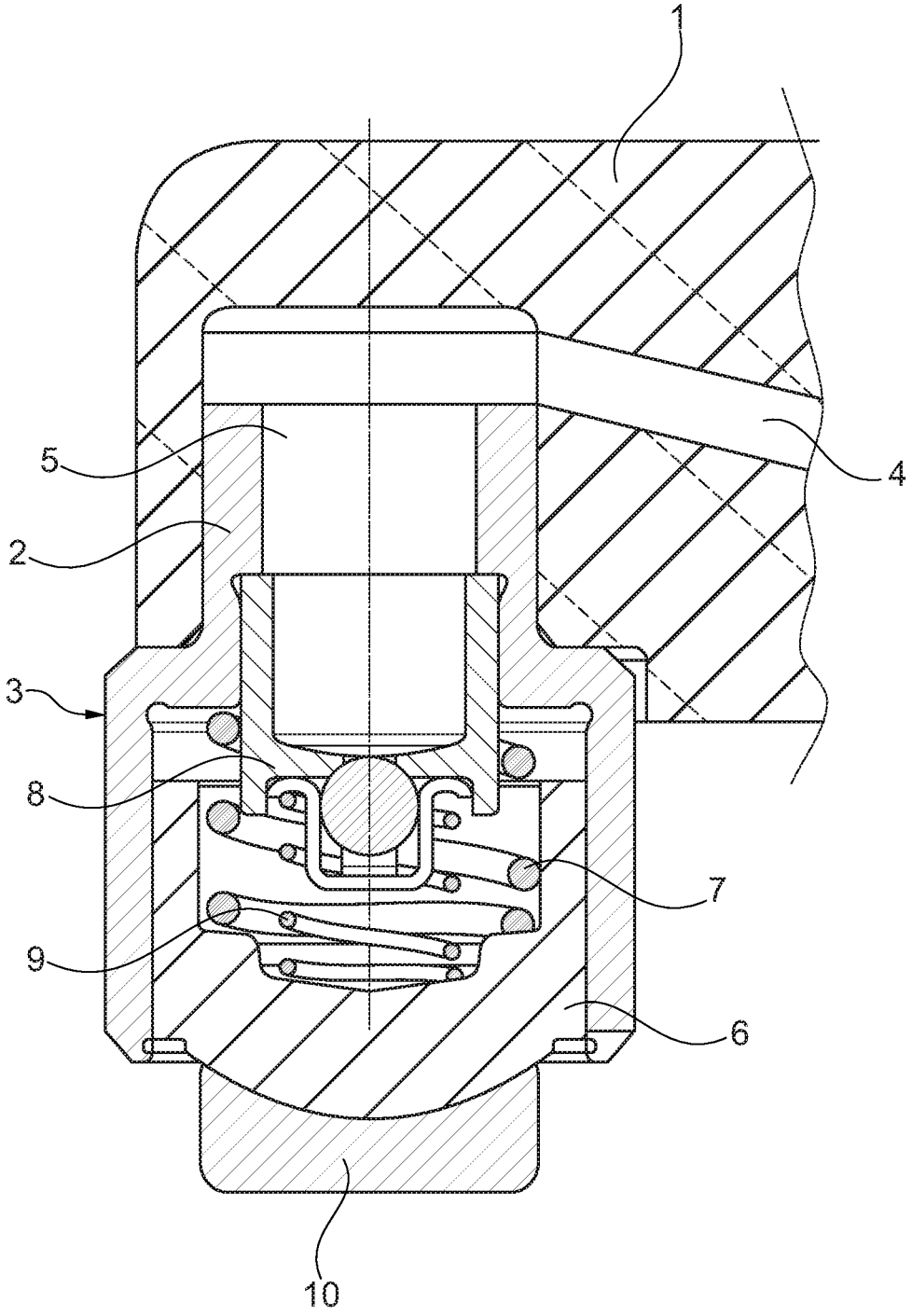
FIG. 1 shows a section through a hydraulic valve lash compensation element and a partial section through a rocker arm end.
Figure 2:
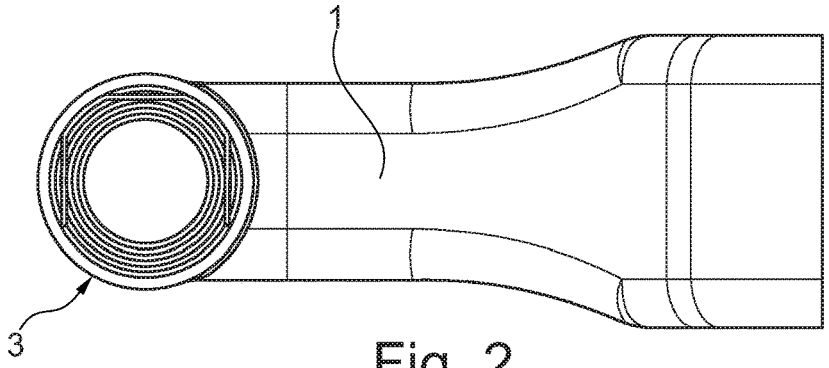
FIG. 2 shows a view of the parts according to FIG. 1 from below, from the view of a gas exchange valve.
Figure 3:
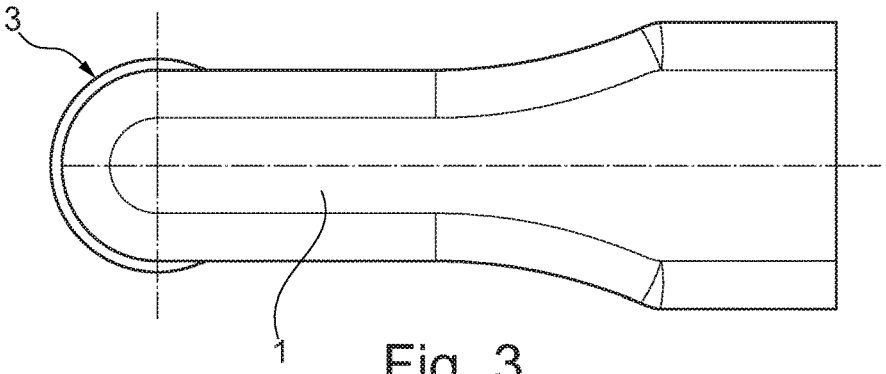
FIG. 3 shows a view according to FIG. 2 from above.
Figure 4:
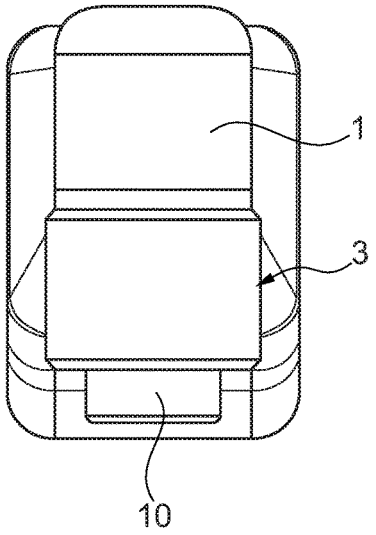
FIG. 4 shows an end-side view of a corresponding rocker arm end.

In FIGS. 1 to 4, as far as shown in detail, 1 designates a rocker arm that has, on its free end, a hole in which a plug-in extension 2 is inserted that is part of a housing 3 of a hydraulic valve lash compensation element. In FIG. 1, in the rocker arm 1 there is a pressurized medium line that is designated with 4 and to which a hollow space 5 in the plug-in extension 2 is connected. In the housing 3 of the HVA, a working piston 6 in installed that is blocked on the outlet from the housing 3 by a spring ring. The working piston 6 is supported by a compression spring 7 on the housing 3 and is loaded by this spring in the direction toward the spring ring. Within the compression spring 7, a valve piston 8 is installed with a ball non-return valve that closes the space within the working piston 6 in a spring-loaded and sealing manner. Within the compression spring 7, another spring 9 can be installed, because an arbitrary construction of the HVA based on the removal of the HVA from the rocker arm head is possible. The free end of the working piston 6 has a hemispherical shape and is in active connection with a spherical head 10 that allows a vertical supporting force on a not-shown gas exchange valve.

LIST OF REFERENCE SYMBOLS

1) Rocker arm
2) Plug-in extension
3) Housing
4) Pressurized medium line
5) Hollow space
6) Working piston
7) Compression spring
8) Valve piston
9) Spring
10) Spherical head

The invention claimed is:

1. A transmission element comprising a rocker arm for a reciprocating piston internal combustion engine that is actuatable on one side by a cam of a camshaft and on the other side is in active connection with at least one gas exchange valve directly or via an intermediate arrangement of a valve bridge, and a hydraulic valve lash compensation element arranged at a force transmission end of and attached to the rocker arm, the hydraulic valve lash compensation element includes a plug-in extension with a first sleeve portion defining a first outer diameter, a second sleeve portion defining a second outer diameter that is greater than the first outer diameter, and a radially extending stepped portion connecting the first sleeve portion and the second sleeve portion, the first sleeve portion being attached to the rocker arm, and a valve piston is slidingly engaged against a radially inner surface of the first sleeve portion of the plug-in extension, and a working piston is slidingly engaged against a radially inner surface of the second sleeve portion of the plug-in extension, the radially extending stepped portion of the plug-in extension defines a shoulder that abuts directly against an axial surface of the rocker arm, and a compression spring is arranged within the plug-in extension, and the shoulder of the plug-in extension defines an axial stop surface for the compression spring and the working piston.

2. The transmission element according to claim 1, wherein the plug-in extension is part of a housing of the hydraulic valve lash compensation element.

3. The transmission element according to claim 2, wherein the plug-in extension has a hollow construction defining a hollow space that is connected to a pressurized medium line in the rocker arm.

4. The transmission element according to claim 3, wherein the housing is constructed to receive the working piston.

5. The transmission element according to claim 4, wherein a leakage gap for ventilation is provided between the working piston or the valve piston installed in the working piston and the housing of the hydraulic valve lash compensation element.

6. The transmission element according to claim 1, wherein the rocker arm includes a borehole in which the first sleeve portion of the plug-in extension is inserted for attachment of the plug-in extension to the rocker arm, and the borehole defines an inner diameter that is less than the second outer diameter of the second sleeve portion.

7. The transmission element according to claim 1, wherein the rocker arm includes a borehole in which the first sleeve portion of the plug-in extension is inserted for attachment of the plug-in extension to the rocker arm, and the rocker arm defines a shoulder surrounding the borehole that defines the axial surface of the rocker arm.

* * * * *